US011125401B2

(12) United States Patent
Chien

(10) Patent No.: US 11,125,401 B2
(45) Date of Patent: Sep. 21, 2021

(54) MULTIPLE FUNCTIONS LED NIGHT LIGHT

(71) Applicant: Tseng-Lu Chien, Walnut, CA (US)

(72) Inventor: Tseng-Lu Chien, Walnut, CA (US)

( * ) Notice: Subject to any disclaimer, the term of this patent is extended or adjusted under 35 U.S.C. 154(b) by 0 days.

(21) Appl. No.: 16/710,276

(22) Filed: Dec. 11, 2019

(65) Prior Publication Data

US 2020/0120310 A1 Apr. 16, 2020

Related U.S. Application Data

(60) Continuation-in-part of application No. 16/242,761, filed on Jan. 8, 2019, which is a continuation of (Continued)

(51) Int. Cl.

| | |
|---|---|
| ***F21S 8/00*** | (2006.01) |
| ***F21V 23/04*** | (2006.01) |
| ***F21V 21/14*** | (2006.01) |
| ***F21V 21/08*** | (2006.01) |
| ***F21V 14/02*** | (2006.01) |
| ***F21S 10/00*** | (2006.01) |
| ***F21S 9/02*** | (2006.01) |
| ***F21V 9/08*** | (2018.01) |
| ***F21V 19/00*** | (2006.01) |
| ***F21K 9/235*** | (2016.01) |
| ***F21Y 115/10*** | (2016.01) |
| ***F21Y 101/00*** | (2016.01) |
| ***F21W 121/00*** | (2006.01) |
| ***F21V 21/30*** | (2006.01) |

(Continued)

(52) U.S. Cl.

CPC ..... *F21S 8/035* (2013.01); *F21S 8/038* (2013.01); *F21S 9/022* (2013.01); *F21S 10/002* (2013.01); *F21V 14/02* (2013.01); *F21V 21/08* (2013.01); *F21V 21/14* (2013.01); *F21V 23/04* (2013.01); *F21V 29/00* (2013.01); *F21K 9/235* (2016.08); *F21V 9/08* (2013.01); *F21V 19/006* (2013.01); *F21V 21/29* (2013.01); *F21V 21/30* (2013.01); *F21V 23/0442* (2013.01); *F21V 23/0492* (2013.01); *F21W 2121/00* (2013.01); *F21Y 2101/00* (2013.01); *F21Y 2115/10* (2016.08); *Y10S 362/80* (2013.01)

(58) Field of Classification Search

CPC ..... F21S 8/035; F21K 9/23; F21K 9/232

See application file for complete search history.

(56) References Cited

U.S. PATENT DOCUMENTS 3,924,914 A 12/1975 Banner
3,974,495 A 8/1976 Jones (Continued)

*Primary Examiner* — William N Harris

(74) *Attorney, Agent, or Firm* — Bacon & Thomas, PLLC

(57) ABSTRACT

A multiple function LED night light has at least one LED device with or without at least one additional function, such as an air-freshener adaptor device, sonic device, frequency device, sensor device, bug repeller device, second light device, timepiece, electric message device, timer device, temperature device, surge protection device, electric short circuit protection device, or base device for installation on an existing lamp socket, emergency light device, or any other electric device suitable for home use to keep people comfortable or safe. The LED device has a first optic element to change the narrow-viewing angle of an LED's spot-light beams into a wider-viewing angle, and a second optic element to help eliminate super bright lighted spots.

27 Claims, 4 Drawing Sheets

Related U.S. Application Data application No. 14/739,397, filed on Jun. 15, 2015, now Pat. No. 10,184,624, which is a continuation of application No. 11/806,285, filed on May 31, 2007, now Pat. No. 11,082,664, application No. 16/710,276, which is a continuation-in-part of application No. 11/498,874, filed on Aug. 4, 2006, now abandoned, which is a continuation of application No. 10/954,189, filed on Oct. 1, 2004, now abandoned, application No. 16/710,276, which is a continuation-in-part of application No. 16/285,631, filed on Feb. 26, 2019, now Pat. No. 10,907,784, and a continuation-in-part of application No. 16/298,110, filed on Mar. 11, 2019, now Pat. No. 10,753,561, which is a continuation-in-part of application No. 11/498,874, filed on Aug. 4, 2006, now abandoned, which is a continuation of application No. 10/954,189, filed on Oct. 1, 2004, now abandoned, said application No. 14/739,397 is a continuation-in-part of application No. 11/806,284, filed on May 31, 2007, now Pat. No. 7,632,004, application No. 16/710,276, which is a division of application No. 11/806,285, filed on May 31, 2007, now Pat. No. 11,082,664.

(51) Int. Cl.
*F21V 21/29* (2006.01)
*F21V 29/00* (2015.01)

(56) References Cited

U.S. PATENT DOCUMENTS 4,816,973 A 3/1989 Atalla et al.
5,924,784 A 7/1999 Chliwnyj et al.
5,964,516 A * 10/1999 Lai ..... F21S 8/035 362/641
6,220,722 B1 4/2001 Begemann
6,474,829 B2 11/2002 Clodfelter
6,478,440 B1 11/2002 Jaworski et al.
6,499,853 B2 12/2002 Stekelenburg
6,499,860 B2 12/2002 Begemann
6,577,073 B2 6/2003 Shimizu et al.
6,585,391 B1 7/2003 Koch
6,648,496 B1 11/2003 Elghoroury et al.
6,709,126 B1 3/2004 Leen
6,762,563 B2 7/2004 St. Germain et al.
6,789,917 B2 9/2004 Parsons
6,905,231 B2 6/2005 Dickie
6,911,915 B2 6/2005 Wu et al.
6,926,426 B2 8/2005 Currie et al.
6,953,264 B2 10/2005 Ter-Hovhannisian
6,964,498 B2 11/2005 Wu
7,025,473 B2 * 4/2006 Dokoupil ..... F21S 8/035 362/640
7,045,975 B2 * 5/2006 Evans ..... F21S 8/035 315/149
7,186,016 B2 * 3/2007 Jao ..... B44C 5/005 362/101
7,355,349 B2 4/2008 Evans
7,419,294 B2 * 9/2008 Lai ..... G02B 6/0045 362/641
7,524,089 B2 4/2009 Park
7,932,482 B2 4/2011 Norwood
2003/0185020 A1 10/2003 Stekelenburg
2004/0246704 A1 12/2004 Burdick
2006/0007709 A1 1/2006 Yuen
2006/0062019 A1 * 3/2006 Young ..... F21S 8/035 362/641
2006/0072346 A1 4/2006 Chien
2006/0077684 A1 * 4/2006 Yuen ..... F21S 8/035 362/555
2006/0146527 A1 7/2006 Vanderschuit
2006/0209569 A1 * 9/2006 Yuen ..... F21S 8/035 362/641
2014/0286015 A1 * 9/2014 Wang ..... F21V 29/507 362/294

* cited by examiner

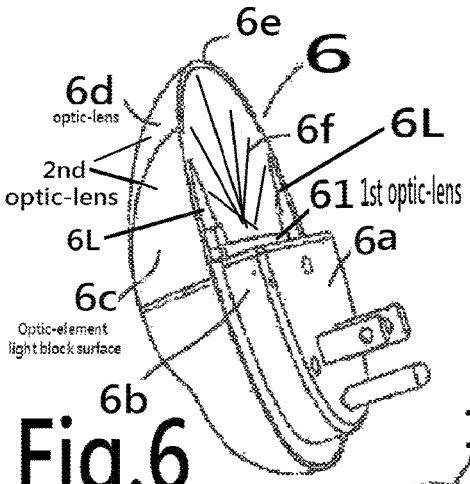
Fig.6
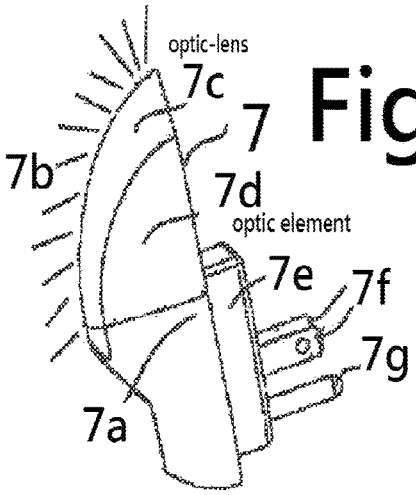
Fig.7
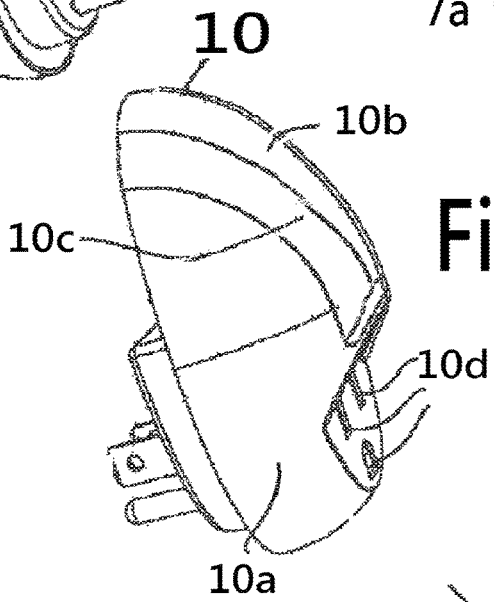
Fig.10
Fig.8
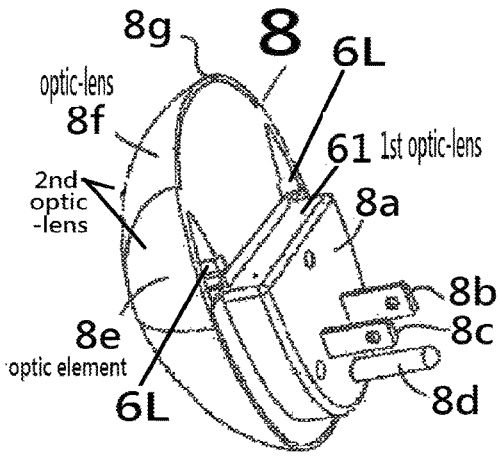
Fig.9
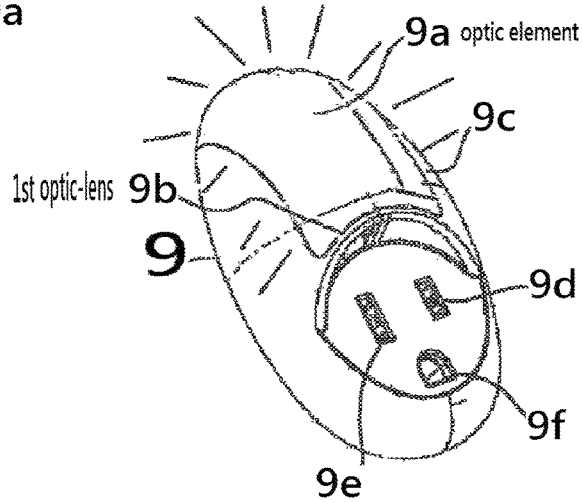

Different with
Prior-Art
6,227,679
5/8-2001

Bug Repellor Device
or
2nd function Device

Q-2007 Issued patent

US007632004B2

(12) United States Patent
Chien

(10) Patent No.: US 7,632,004 B2
(45) Date of Patent: Dec. 15, 2009

(54) LED NIGHT LIGHT WITH MORE THAN 1 OPTICS MEANS

(76) Inventor: Tseng-Lu Chien, 8F, No 29, Alley 75, Lin-Shen Road, Shi-Chi Town, Taipei Hsien (TW)

( * ) Notice: Subject to any disclaimer, the term of this patent is extended or adjusted under 35 U.S.C. 154(b) by 132 days.

(21) Appl. No : 11/806,284

(22) Filed: May 31, 2007

(65) Prior Publication Data

US 2008/0304289 A1 Dec. 11, 2008

(51) Int. Cl.
*F21V 23/00* (2006.01)

(52) U.S. Cl. ..... 362/641; 362/642, 362/643; 362/644

(58) Field of Classification Search ..... 362/641–644, 362/800, 555, 640, 801, 802, 551, 318
See application file for complete search history.

(56) References Cited

U.S. PATENT DOCUMENTS

| | | | | |
|---|---|---|---|---|
| 6,945,441 | B1 * | 10/2005 | Chien | 362/96 |
| 2006/0007709 | A1 * | 1/2006 | Yuan | 362/641 |
| 2007/0253222 | A1 * | 11/2007 | Drisko et al. | 362/641 |

* cited by examiner

*Primary Examiner*—Bao Q Truong
(74) *Attorney, Agent, or Firm*—Bacon & Thomas, PLLC

(57) ABSTRACT

An LED night light having more than one optics means includes a first optics element to change a narrow-viewing angle of the LED's spot-light beams into a wider-viewing angle for area illumination, and a second optics device to help enhance the appearance and value of the LED night light without taking up excess space. Other functions and devices such as an outlet adaptor, motion sensor, PIR sensor, air freshener, second light, bug repellent, sonic repellent, time piece or any combination of such functions or features may easily be added to increase the utility of the said LED night light while reducing electric power consumption and saving money for consumers.

7 Claims, 1 Drawing Sheet

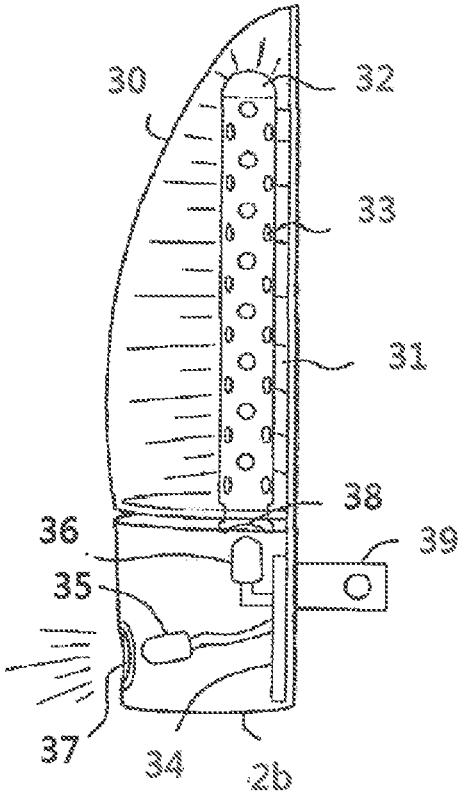

FIG. 14

Parent Case
having
6 pending case
more than 1
(a) optics-lens
element(s)
(b) function(s)

MULTIPLE FUNCTIONS LED NIGHT LIGHT

RELATED U.S. PATENT DOCUMENTS

This application is a division of U.S. patent application Ser. No. 11/806,285 (hereafter as #R-2007), Ser. No. 11/806,284 (hereafter as Q-2007) both applications are filed May 31, 2007, and herein incorporated by reference.

This application is a division of

U.S. patent application Ser. No. 16/242,761, filed Jan. 8, 2019, (hereafter as #R-4)

Multiple function LED night light

This application is a division of

U.S. patent application Ser. No. 14/739,499, filed Jun. 15, 2015, (hereafter as #R-3), now is U.S. Pat. No. 10,487,999 patented Multiple function LED night light This application is a division of U.S. patent application Ser. No. 14/739,666, filed Jun. 15, 2015, (hereafter as #R-2), now allowed Multiple function LED night light This application is a division of U.S. patent application Ser. No. 14/739,397, filed Jun. 15, 2015, (hereafter as #R-1), now is U.S. Pat. No. 10,184,624

Multiple function LED night light now is U.S. Pat. No. 10,184,624 issued on Jan. 22, 2019

This application is a division of

U.S. patent application Ser. No. 11/806,285, filed May 31, 2007, (hereafter as #R-07)

This application is a division of

U.S. patent application Ser. No. 11/806,284, filed May 31, 2007, (hereafter as #Q-07) now U.S. Pat. No. 7,632,004

LED night light with more than one optics means now is U.S. Pat. No. 7,632,004 issued on Dec. 15, 2009

This application is a continuation of

U.S. application Ser. No. 11/498,874 file don Aug. 4, 2006

(hereafter as #K-06)

LED night light has area-illumination by multiple time reflection and refraction 20

This application is a continuation of

U.S. application Ser. No. 10/954,189 filed on Oct. 1, 2004.

This application is a continuation of

U.S. patent application Ser. No. 11/527,628, filed Sep. 27, 2006, (hereafter as #M-06)

multiple functions LED night light with air freshener now is U.S. Pat. No. 7,611,253 issue on Nov. 3, 2009, This application is a continuation of U.S. patent application Ser. No. 11/527,629, filed Sep. 27, 2006, (hereafter #L) now U.S. Pat. No. 8,545,090

LED night light with changeable display unit now is U.S. Pat. No. 8,545,090 issue on Oct. 1, 2013, This application is a continuation of U.S. patent application Ser. No. 14/252,102, filed Apr. 14, 2014, (hereafter as #J-6) now is U.S. Pat. No. 9,128,692

LED night light with time piece now is U.S. Pat. No. 9,128,692 issue on Sep. 8, 2015, This application is a continuation of (#J5) now is U.S. Pat. No. 8,811,122

LED night light with time piece

U.S. patent application Ser. No. 13/428,086, filed Mar. 23, 2012, now is U.S. Pat. No. 8,811,122 issue on Aug. 19, 2014, This application is a continuation of U.S. patent application Ser. No. 12/894,782, filed Sep. 30, 2010, (hereafter as #J-4) now is U.S. Pat. No. 8,289,814

LED night light with time piece now is U.S. Pat. No. 8,289,814 issue on Oct. 16, 2012, This application is a continuation of U.S. patent application Ser. No. 12/545,922, filed Aug. 24, 2009, (hereafter as #J-3) now is U.S. Pat. No. 8,164,984

LED night light with time piece now is U.S. Pat. No. 8,164,984 issue on Apr. 24, 2012, This application is a continuation of U.S. patent application Ser. No. 11/498,881, filed Aug. 4, 2006, (hereafter as #1-2006) U.S. Pat. No. 7,568,829 poly night light now is U.S. Pat. No. 7,568,829 issue on Aug. 4, 2009,

This application is a continuation of

U.S. patent application Ser. No. 12/546,012, filed Aug. 24, 2009, (hereafter as #H-1) U.S. Pat. No. 8,029,182 multiple light source night light now is U.S. Pat. No. 8,029,182 issue on Oct. 4, 201, which is a continuation of U.S. patent application Ser. No. 11/255,981, filed Oct. 24, 2005, (hereafter as #H-2005) U.S. Pat. No. 7,455,444

Multiple light source Night light now is U.S. Pat. No. 7,455,444 issued on Nov. 25, 2008 which is CIP of

U.S. application Ser. No. 11/094,215 filed on Mar. 31, 2005

(hereafter as #E-2005) U.S. Pat. No. 7,909,477

LED night light with liquid optics medium now is U.S. Pat. No. 7,909,477 issue on Mar. 22, 2011, which is CIP of U.S. application Ser. No. 11/092,742 filed on May 30, 2005

(hereafter as #D-2005) U.S. Pat. No. 7,997,785

Linear tube night light with changeable patterns now is U.S. Pat. No. 7,997,785 issue on Aug. 16, 2011, which is CIP of U.S. application Ser. No. 11/092,741 filed on May 30, 2005

(hereafter as #C-2005) U.S. Pat. No. 7,232,251

Night light with Fiber Optics now is U.S. Pat. No. 7,232,251 issue on Jun. 19, 2007, which is CIP of U.S. application Ser. No. 11/094,156 filed on May 31, 2005

(hereafter as #B-2005) U.S. Pat. No. 7,318,653

Multiple Function wall cover plate now is U.S. Pat. No. 7,318,653 issue on Jan. 15, 2008, which is CIP of U.S. application Ser. No. 11/094,155 filed on Mar. 31, 2005

(hereafter as #A-2005) U.S. Pat. No. 7,810,985

Multiple function EL night light now is U.S. Pat. No. 7,810,985 issue on Oct. 12, 2010, The current invention also is continuously filing of U.S. application Ser. No. 14/817,675 filed on Aug. 4, 2015
(hereafter as #VVV-1)
Multiple function night light has built-in USB and light means
Which is continuously filing of
U.S. application Ser. No. 13/910,295 filed on Jun. 5, 2013
(hereafter as #VVV)
Multiple function night light has built-in USB and light means
Which is continuously filing of
U.S. application Ser. No. 13/858,604 filed on Apr. 8, 2013
(hereafter as #RRR)
Which is continuously filing of
U.S. application Ser. No. 13/117,227 filed on May 27, 2011
(hereafter as #FFF)
Universal module has USB-unit or/and outlet-unit(s) for variety of electric or digital data device(s)
Which is CIP of Ser. No. 12/894,782 filed on Sep. 30, 2010,
(hereafter as #J4)
Which is CIP of Ser. No. 12/502,661 filed on Jul. 14, 2009
Which is CIP of Ser. No. 12/292,580 filed on Nov. 21, 2008
(hereafter as #J-2)
Which is CIP of Ser. No. 12/566,322 filed on Sep. 24, 2009
Which is CIP of Ser. No. 11/498,874 filed on Aug. 4, 2006,
(hereafter as #K)
Which is CIP of Ser. No. 11/527,627 filed on Sep. 27, 2006,
Which is CIP of Ser. No. 12/622,000 filed on Nov. 19, 2009,
(hereafter as #L)
Which is CIP of Ser. No. 12/624,621 filed on Nov. 24, 2009,
And current invention also is Continuous filing of
U.S. application Ser. No. 12/914,584 filed on Oct. 28, 2010,
Div. of Ser. No. 12/318,470 filed on Dec. 30, 2008, May 13, 2014 issues.
(hereafter as #FF-1) "LED project Night Light" now is U.S. Pat. No. 8,721,160
Which is CIP of
U.S. application Ser. No. 12/073,889 filed on Mar. 11, 2008, (hereafter as #X) LED light with changeable LED position with preferable power source
now is U.S. Pat. No. 8,827,511 issued on Sep. 9, 2014
Which is CIP of
U.S. application Ser. No. 11/527,629 filed Sep. 27, 2006,
(hereafter as #L) "LED night light with interchangeable display unit" now is U.S. Pat. No. 8,545,090 issued Oct. 1, 131
Which is CIP of
U.S. application Ser. No. 12/894,865 filed on Sep. 30, 2010
(hereafter as #T-1) LED light device with changeable features now is U.S. Pat. No. 8,393,755 issued Mar. 12, 2013
Which is CIP of
(#J-5) "Time piece with LED night light" now is U.S. Pat. No. 8,811,122
Which is CIP of
U.S. application Ser. No. 13/428,086 filed Mar. 23, 2012, Aug. 19, 2014 issued.
Which is CIP
U.S. application Ser. No. 12/292,580 filed on Nov. 21, 2008 U.S. Pat. No. 8,305,846
Which is CIP U.S. application Ser. No. 11/527,631 filed Sep. 27, 2006.
Which is CIP of
U.S. application Ser. No. 12/894,782 filed Sep. 30, 2010,
(hereafter as #J-4) "Time Piece with LED night light" now is U.S. Pat. No. 8,289,814
Which is CIP of
U.S. application Ser. No. 12/545,992 filed Aug. 24, 2009,
Which is
CIP of U.S. application Ser. No. 12/292,580 filed on Nov. 21, 2008,
Which is
CIP of U.S. application Ser. No. 11/527,631 filed Sep. 27, 2006.
Which is CIP of
U.S. application Ser. No. 12/292,580 filed Nov. 21, 2008,
(hereafter as #J-2) "Time piece with LED night light" now is U.S. Pat. No. 8,305,846
Which is CIP of
U.S. application Ser. No. 11/527,631 filed Sep. 27, 2006

BACKGROUND

This application is a division of U.S. patent application Ser. No. 11/806,285 (hereafter as #R-2007), Ser. No. 11/806,284 (hereafter as Q-2007) both applications are filed May 31, 2007, and herein incorporated by reference.
This application is a division of
U.S. patent application Ser. No. 16/242,761, filed Jan. 8, 2019, (hereafter as #R-4)
Multiple function LED night light
This application is a division of
U.S. patent application Ser. No. 14/739,499, filed Jun. 15, 2015,
(hereafter as #R-3), now is U.S. Pat. No. 10,487,999 patented
Multiple function LED night light
This application is a division of
U.S. patent application Ser. No. 14/739,666, filed Jun. 15, 2015,
(hereafter as #R-2), now allowed
Multiple function LED night light
This application is a division of
U.S. patent application Ser. No. 14/739,397, filed Jun. 15, 2015,
(hereafter as #R-1), now is U.S. Pat. No. 10,184,624
Multiple function LED night light
now is U.S. Pat. No. 10,184,624 issued on Jan. 22, 2019
This application is a division of
U.S. patent application Ser. No. 11/806,285, filed May 31, 2007,
(hereafter as #R-07)
This application is a division of
U.S. patent application Ser. No. 11/806,284, filed May 31, 2007,
(hereafter as #Q-07) now U.S. Pat. No. 7,632,004
LED night light with more than one optics means
now is U.S. Pat. No. 7,632,004 issued on Dec. 15, 2009
This application is a continuation of
U.S. application Ser. No. 11/498,874 file don Aug. 4, 2006
(hereafter as #K-06)
LED night light has area-illumination by multiple time reflection and refraction 20

This application is a continuation of
U.S. application Ser. No. 10/954,189 filed on Oct. 1, 2004.
This application is a continuation of
U.S. patent application Ser. No. 11/527,628, filed Sep. 27, 2006,
(hereafter as #M-06)
multiple functions LED night light with air freshener
now is U.S. Pat. No. 7,611,253 issue on Nov. 3, 2009,
This application is a continuation of
U.S. patent application Ser. No. 11/527,629, filed Sep. 27, 2006,
(hereafter #L) now U.S. Pat. No. 8,545,090
LED night light with changeable display unit
now is U.S. Pat. No. 8,545,090 issue on Oct. 1, 2013,
This application is a continuation of
U.S. patent application Ser. No. 14/252,102, filed Apr. 14, 2014,
(hereafter as #J-6) now is U.S. Pat. No. 9,128,692
LED night light with time piece
now is U.S. Pat. No. 9,128,692 issue on Sep. 8, 2015,
This application is a continuation of (#J5) now is U.S. Pat. No. 8,811,122
LED night light with time piece
U.S. patent application Ser. No. 13/428,086, filed Mar. 23, 2012, now is U.S. Pat. No. 8,811,122 issue on Aug. 19, 2014,
This application is a continuation of
U.S. patent application Ser. No. 12/894,782, filed Sep. 30, 2010,
(hereafter as #J-4) now is U.S. Pat. No. 8,289,814
LED night light with time piece
now is U.S. Pat. No. 8,289,814 issue on Oct. 16, 2012,
This application is a continuation of
U.S. patent application Ser. No. 12/545,922, filed Aug. 24, 2009,
(hereafter as #J-3) now is U.S. Pat. No. 8,164,984
LED night light with time piece
now is U.S. Pat. No. 8,164,984 issue on Apr. 24, 2012,
This application is a continuation of U.S. patent application Ser. No. 11/498,881, filed Aug. 4, 2006,
(hereafter as #1-2006) U.S. Pat. No. 7,568,829
poly night light
now is U.S. Pat. No. 7,568,829 issue on Aug. 4, 2009,
This application is a continuation of
U.S. patent application Ser. No. 12/546,012, filed Aug. 24, 2009,
(hereafter as #H-1) U.S. Pat. No. 8,029,182
multiple light source night light
now is U.S. Pat. No. 8,029,182 issue on Oct. 4, 201,
which is a continuation of
U.S. patent application Ser. No. 11/255,981, filed Oct. 24, 2005, (hereafter as #H-2005)
U.S. Pat. No. 7,455,444
Multiple light source Night light
now is U.S. Pat. No. 7,455,444 issued on Nov. 25, 2008
which is CIP of
U.S. application Ser. No. 11/094,215 filed on Mar. 31, 2005
(hereafter as #E-2005) U.S. Pat. No. 7,909,477
LED night light with liquid optics medium
now is U.S. Pat. No. 7,909,477 issue on Mar. 22, 2011,
which is CIP of
U.S. application Ser. No. 11/092,742 filed on May 30, 2005
(hereafter as #D-2005) U.S. Pat. No. 7,997,785
Linear tube night light with changeable patterns
now is U.S. Pat. No. 7,997,785 issue on Aug. 16, 2011,
which is CIP of
U.S. application Ser. No. 11/092,741 filed on May 30, 2005
(hereafter as #C-2005) U.S. Pat. No. 7,232,251
Night light with Fiber Optics
now is U.S. Pat. No. 7,232,251 issue on Jun. 19, 2007,
which is CIP of
U.S. application Ser. No. 11/094,156 filed on May 31, 2005
(hereafter as #B-2005) U.S. Pat. No. 7,318,653
Multiple Function wall cover plate
now is U.S. Pat. No. 7,318,653 issue on Jan. 15, 2008,
which is CIP of
U.S. application Ser. No. 11/094,155 filed on Mar. 31, 2005
(hereafter as #A-2005) U.S. Pat. No. 7,810,985
Multiple function EL night light
now is U.S. Pat. No. 7,810,985 issue on Oct. 12, 2010,
The current invention also is continuously filing of U.S. application Ser. No. 14/817,675 filed on Aug. 4, 2015
(hereafter as #VVV-1)
Multiple function night light has built-in USB and light means
Which is continuously filing of
U.S. application Ser. No. 13/910,295 filed on Jun. 5, 2013
(hereafter as #VVV)
Multiple function night light has built-in USB and light means
Which is continuously filing of
U.S. application Ser. No. 13/858,604 filed on Apr. 8, 2013
(hereafter as #RRR)
Which is continuously filing of
U.S. application Ser. No. 13/117,227 filed on May 27, 2011
(hereafter as #FFF)
Universal module has USB-unit or/and outlet-unit(s) for variety of electric or digital data device(s)
Which is CIP of Ser. No. 12/894,782 filed on Sep. 30, 2010,
(hereafter as #J4)
Which is CIP of Ser. No. 12/502,661 filed on Jul. 14, 2009
Which is CIP of Ser. No. 12/292,580 filed on Nov. 21, 2008
(hereafter as #J-2)
Which is CIP of Ser. No. 12/566,322 filed on Sep. 24, 2009
Which is CIP of Ser. No. 11/498,874 filed on Aug. 4, 2006,
(hereafter as #K)
Which is CIP of Ser. No. 11/527,627 filed on Sep. 27, 2006,
Which is CIP of Ser. No. 12/622,000 filed on Nov. 19, 2009,
(hereafter as #L)
Which is CIP of Ser. No. 12/624,621 filed on Nov. 24, 2009,
And current invention also is Continuous filing of
U.S. application Ser. No. 12/914,584 filed on Oct. 28, 2010,
Div. of Ser. No. 12/318,470 filed on Dec. 30, 2008, May 13, 2014 issues.
(hereafter as #FF-1) "LED project Night Light" now is U.S. Pat. No. 8,721,160
Which is CIP of
U.S. application Ser. No. 12/073,889 filed on Mar. 11, 2008, (hereafter as #X) LED light with changeable LED position with preferable power source now is U.S. Pat. No. 8,827,511 issued on Sep. 9, 2014

Which is CIP of

U.S. application Ser. No. 11/527,629 filed Sep. 27, 2006, (hereafter as #L) "LED night light with interchangeable display unit" now is U.S. Pat. No. 8,545,090 issued Oct. 1, 131

Which is CIP of

U.S. application Ser. No. 12/894,865 filed on Sep. 30, 2010

(hereafter as #T-1) LED light device with changeable features now is U.S. Pat. No. 8,393,755 issued Mar. 12, 2013

Which is CIP of (#J-5) "Time piece with LED night light" now is U.S. Pat. No. 8,811,122

Which is CIP of

U.S. application Ser. No. 13/428,086 filed Mar. 23, 2012, Aug. 19, 2014 issued.

Which is CIP

U.S. application Ser. No. 12/292,580 filed on Nov. 21, 2008 U.S. Pat. No. 8,305,846

Which is CIP U.S. application Ser. No. 11/527,631 filed Sep. 27, 2006.

Which is CIP of

U.S. application Ser. No. 12/894,782 filed Sep. 30, 2010, (hereafter as #J-4) "Time Piece with LED night light" now is U.S. Pat. No. 8,289,814

Which is CIP of

U.S. application Ser. No. 12/545,992 filed Aug. 24, 2009,

Which is

CIP of U.S. application Ser. No. 12/292,580 filed on Nov. 21, 2008,

Which is

CIP of U.S. application Ser. No. 11/527,631 filed Sep. 27, 2006.

Which is CIP of

U.S. application Ser. No. 12/292,580 filed Nov. 21, 2008, (hereafter as #J-2) "Time piece with LED night light" now is U.S. Pat. No. 8,305,846

Which is CIP of

U.S. application Ser. No. 11/527,631 filed Sep. 27, 2006

The following U.S. patent applications by the same Inventor also are directed to night lights: Ser. No. 10/883,747, filed Jul. 6, 2004; Ser. No. 11/092,741; Ser. No. 11/094,215; Ser. No. 11/255,981; Ser. No. 11/498,881; Ser. No. 11/527,631; Ser. No. 11/498,874; Ser. No. 11/527,629; and Ser. No. 11/527,628.

In addition, the Inventor's U.S. Pat. Nos. 5,926,440; 6,158,868; 6,170,958; 6,171,117; 6,280,053 disclose arrangements of conductive means for night lights and multiple function night lights incorporated time pieces. Other U.S. Pat. Nos. 4,947,291; 5,495,402; 5,662,408; 5,713,655; 5,803,579; 5,816,682; 5,833,350; 5,893,626; 5,998,928; 6,000,807; 6,010,228; 6,031,958; 6,033,087; 6,056,420; 6,132,072; 6,160,948; 6,161,910; 6,183,101; 6,190,017; 6,290,368; 6,337,946; 6,386,730; 6,390,647; 6,00,104; 6,411,524; 6,431,719; 6,509,832; 6,523,976; 6,550,949; 6,609,812; 6,623,416; 6,641,289; 6,648,496; and 6,709,126 all show different light sources and applications but none teaches an LED night light having multiple functions which may be selected from the group including an adaptor device, fan device, heat device, bug repeller device, sonic device, frequency device, or any other home electric appliance or device suitable for adding onto an LED night light.

The current invention offers a big improvement in power saving because it incorporates the low power consumption Light Emitting Diode (LED) to replace the incandescent bulb which normally uses a 4 Watt or 7 Watt or more power consumption light means. A single LED normally has a 0.3 Watt+/−100% power consumption depending on the product design and illumination needed.

The current invention not only provides a power saving device but also reduces a consumer's monthly electricity expense. The current invention also supplies two or more additional practical functions to the consumer, which may selected from, for example, an air-freshener and/or (as described in co-pending U.S. patent application Ser. Nos. 11/527,631; 11/527,629; 11/498,881; 11/498,874; and Ser. No. 11/527,628; etc.) an adaptor device, sonic device, frequency device, bug repeller device, second light device, timepiece, electric message device, timer device, temperature device, surge protection device, electric short circuit protection device, base device for installation on an existing lamp socket, emergency light device, or any other electric device(s) used in a home to keep people comfortable or safe.

This current invention optionally may further incorporate the teachings of the co-pending application entitled "LED night light with more than one optics means" concerning the inclusion in the LED night light of an optical element that improves the visibility of light beams from the LED.

All existing LED nightlights have the big problem that the LED unit can be seen by a viewer over a narrow viewing angle only, and that the brightness over that angle is too strong, resulting in spot-light effects (super bright in a small area). The co-pending application teaches multiple (more than one) optics means to provide a big improvement from spot light to linear or area brightness, thereby causing the spot-light effects to change to a nice looking lighting effect such as that provided by a fluorescent tube. It is very difficult to use only one piece of optics means to cause the strong spot-light LED unit(s) to have nice and warm light effects that can be seen by a viewer. This is a big improvement in the LED night light.

The current invention further adds some other arrangement such as reflector(s), bubble(s), or lens(es) within any of the optics element(s) or optic-lens to increase the effects of modifying the narrow viewing angle light beams emitted out of the LED(s) to provide linear or area light effects.

Furthermore, the current LED night light invention solves several problems with the most popular night light in the marketplace. The most popular night light length is around 88 mm+/−50 mm (with base), The outer optics-lens or optical elements or expose wall height is around 60 mm+/−30 mm (without base). The height from the wall outlet cover is around 35 mm+/−15 mm (from outlet cover surface). If the LED unit is placed on the same location as the outlet cover surface, the distance from the wall to the outside of the optics-lens or optical elements or expose wall will be less than 35 mm+/−15 mm, which is too short to eliminate the spot-light LED's into a surface or area photometric or lighted area having illumination without super bright spot(s)-light. The problem is solved by using two optics-lens or optic-element(s) or-and exposed wall(s) to get a good surface or area lighting effect with super bright lighted spot(s) or even brightness performance on the outer optics-lens, or exposed wall or optical-element(s). In addition, the LED night light power consumption will fall within the 0.3 W+/−100% per LED range, whereas the power consumption of a bulb night light falls within 4 Watt+/−50% per bulb. So, the LED night light will have a big power saving and reduce the monthly electric bill for the consumer.

The current invention not only provides a simple multiple function LED night light, but also provides excellent light performance. The LED night light with more than one function can add any function selected from, by way of example, an adaptor device, motion sensor device, PIR sensor device, air freshener, second light device, bug repellent device, sonic repellent device, surge protection device, emergency light device, time device, timer device, or any combination so the LED night light can be have nice light performance with more than single functions.

BRIEF DRAWINGS

FIGS. 6-10 are perspective views at different viewing angles of a second preferred embodiment of a multiple function LED night light.

Figure 1:
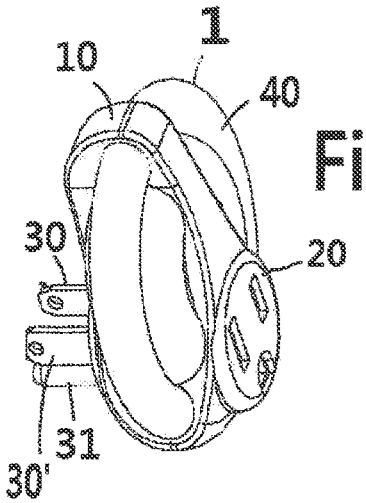
FIGS. 1-4 are perspective views taken from different viewing angles showing a first preferred embodiment of a multiple function of LED night light.

FIG. 14 show the (#Q-07) Parent filing case for (#FF-4) (#FF-3) (#FF-2) (#FF-1) and (#II-2009) (#II-II) is the (#Q-07) as above discussed so not discuss more details here. Which also is parent filed case of (#R-2007) which is filed on same date of (#Q-2007) which is parent of division filed cases of (#R-1) (#R-2) (#R-3) (#R-4) (#R-5) (#R-6). From FIG. 14 show the background discussed the co-pending case (#R-6) (#R-5) (#R-4) (#R-2) (#R-2007) for LED night light has more than one optical element(s) as drawing FIG. 14 show details abstract which has $1^{st}$ (31) and $2^{nd}$ (30) optics-element(s). Where the said $1^{st}$ (31) optic-element(s) have at least one function(s) select from (i) to eliminate the at least one LED(s) (36) super brightness spot-light(s) to none super brightness spot-light(s) or very close even brightness, (ii) prevent people from touch LED(s) (31) or inner electric parts (34) on PCB, (3) allow the LED(s) light beam to passing through.

One of preferred embodiment, from FIG. 14 show the $1^{st}$ optics-element or optics-lens is one of tube construction. It is appreciated the $1^{st}$ optic-lens can be any construction such as dome (short of tube (30)), cone (sharp top of tube (30)), partial circle (half of tube (33)), curved piece (less than ½ tube (30)), flat piece; with or without air-bubble (33), reflectors (33), reflective, refractive, reflective and refractive optics-properties.

One of preferred embodiment, from FIG. 14 show the $2^{nd}$ optics-element or $2^{nd}$ optic-lens or $2^{nd}$ outer piece is one of detachable, separated piece which at least lack of one of (i) rear housing, (ii) side housing, (iii) rear and all sides housing; with or without at least one of (aa) U-shape or other-shape opening, (bb) built-in or add-on clipper, (cc) geometric shape clipper to clip-on or push-tight or assembled with base (2*b*) neck or groove or ditch (38).

One of preferred embodiment, from FIG. 14 show the said LED night light has built-in at least one of $2^{nd}$ LED(s) or more LED(s) to create at least one preferred light functions or performance for examples (i) color changing, (ii) color selection, (iii) brightness adjustable, (iv) fade-in or fade-out, or (v) other LED light function(s) or effect(s) available from marketplace while incorporate with at least one of (aaa) sensor (37), (bbb) IC on PCB, (ccc) switch(s), (ddd) wireless controller, (eee) slide switch.

From FIG. 14 also disclosure the said LED night light have at least one of additional functions, or features select from (additional 1) outlet(s), or female receiving end(s), or terminal(s), or output(s), or port(s), as co-pending (#R-2007 U.S. patent Ser. No. 11/806,285 filed on May 31, 2007 same date of FIG. 30 which is (#Q-2007)).

(additional 2) motion/radar/photo/CDS sensor, (additional 3) PIR sensor, (additional 4) Air Freshener (additional 5) second LED light or color LED light for area(s) or status indicator illumination.

(additional 6) bug repellent, (additional 7) sonic repellent, (additional 8) time piece, (additional 9) supply AC or DC power device through outlet(s) or charger system(s)

(additional 9) any electric function(s) or features(s) combination from marketplace

DETAILED DESCRIPTION

This application is Division of U.S. patent application Ser. No. 11/806,285 (hereafter as #R-2007), Ser. No. 11/806,284 (hereafter as Q-2007) both applications are filed May 31, 2007, and herein incorporated by reference.

FIG. 1 shows a first preferred embodiment of a multiple functions LED night light in which the added function is adaptor device. The added function(s) may alternatively be selected from the devices described in co-pending U.S. patent application Ser. Nos. 11/527,631; 11/527,629; 11/498,881; 11/498,874; and 11/527,628 etc.), such as an air freshener, adaptor device, sonic device, frequency device, bug repeller device, second light device, timepiece, electric message device, timer device, temperature device, surge protection device, electric short circuit protection device, base device for installation on an existing lamp socket, emergency light device, or any other electric device(s) suitable for home use to keep people comfortable or safe. The added function(s) may be one to N (any number) to make a very practical multiple functions LED night light.

As shown in FIG. 1, the multiple function LED night light (1) has a back housing (10) assembled with a front housing (20) and arranged to capture prong means (30) (30') (31) within and enable delivery of electricity from the outlet power source to the other electric appliance device. An optics means (40) exhibits light effects from the inner LED or LEDs to provide a light performance having pre-determined functions, time, duration and so forth as required.

Figure 2:
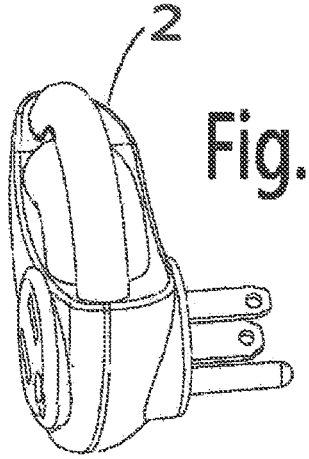
Figure 3:
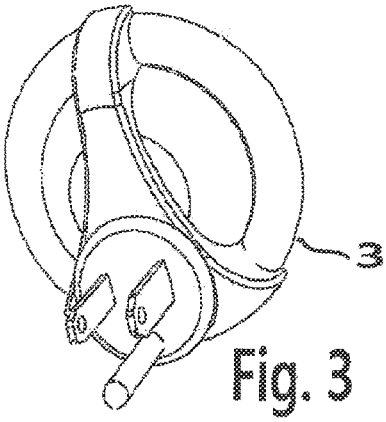
Figure 4:
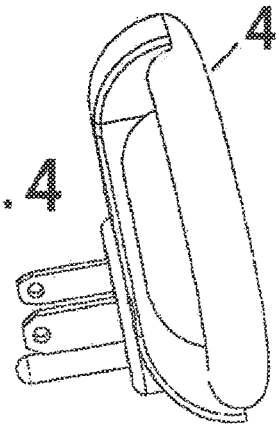

FIGS. 2-4 show the multiple function LED night light of FIG. 1 from different viewing angles. FIG. shows details of the inner construction of the multiple function LED night light (5) which has a back housing (100) and which holds an optics medium (400) having a ring design which is adjacent a circuit board (50) connected to prong means (300) (300') to deliver input home electricity to the LEDs (60) (70) and cause the LEDs (60) (70) to emit a light beam into the optics means (400) from the two input ends (60') and (70'). The preferred input ends are "U" shaped so as to allow as many of the light beams emitted from the LEDs (60) (70) to enter the optics means as possible. Some applications may have other designs for the optics means' input ends, which is not a limitation for the current invention's preferred embodiment description. The input ends design can be any type which is still within the current invention scope. The prong means (310) is a grounded type to provide more safety for the adaptor device. This prong arrangement can be varied depending on the different requirements of safety authorities or governments.

Figure 5:
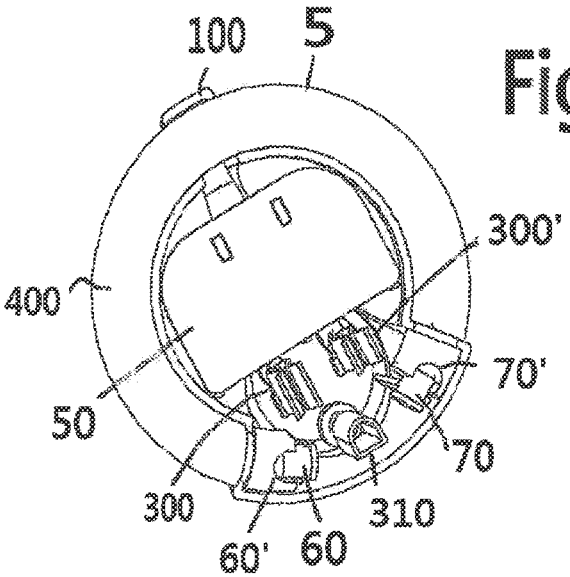
FIG. 5 is a partially cut-away front view showing construction details of the preferred embodiment illustrated in FIGS. 1-4.

The optics means of FIG. 5 may have different arrangements that use sand-blasting to make the surface very rough and allow all the light to travel within without excess leakage, or use a plurality of the air-bubbles (or equivalent reflectors) inside the optics medium to cause light beams from the LEDs to exit the optics medium with splendid bright spots showing along the length of the medium.

As shown in FIG. 5, the circuit (50) may incorporate desired electric components selected from the group including, alone or in combination, at least one resistor, capacitor, switch means, sensor means, diode, inductor, transformer, integrated circuit (hereafter as IC), or any available components suitable for electrically driving LED(s) to have predetermined functions, duration, time, effects, and/or brightness.

The appropriate conductive piece used for the electric connection to the prong means (300) (300') (310) and LEDs (60) (70) can be obtained from the marketplace and may include electric wires, and/or a harness, cable, spring, metal piece, or other conductive means without departing from the scope of the invention, as long as an electric signal can be delivered from the circuit (50) to the prong means and LEDs means.

FIGS. 6-10 show the same features as FIGS. 1-5, the only difference being the different housing (6*b*), optic-lens (6*c*), $1^{st}$ optic-lens (61), and $2^{nd}$ optic lens(6*d*) or $2^{nd}$ optics element (6*c*) design with flat (61) or dome (same as parent Ser. No. 11/806,284) to arrange the LEDs, prong, circuit, and added device(s) inside prong unit or base (6*a*) to prevent people to touch inner electric parts of the simple plug-in always-on LED night light and emit the white or other color always-on illumination.

From FIG. 6 and below 29 features, the said LED light has prong unit or base (6*a*) has circuitry inside to change AC current from outlet into desired current for inner LED or LED(s) light source(s) to turn-on LED for always-on illumination while plug into wall outlet or desired functions. The LED or LED(s) light-beam through top, front, side, bottom 1st optic-lens (61) and emit to the 2nd preferred optic-lens(6*d*) or optics-element (6*c*) which has optics treatment(s) to make the narrow emit-angle LED or LED(s) light beam to spread out to whole or big-size surface of the said $2^{nd}$ optics-lens (6*d*) or light block optics-element (6*c*) having opening(s) or light transmitting area(s) which is different with optics-lens (400) of FIGS. 1 to 5.

The said FIG. 5 the $1^{st}$ optic-lens (40) is solid and circle or donut or arc shape and is solid-piece without space inside to add parts inside optic-lens(40) and LED emit light to $1^{st}$ optic-lens(40) and emit to $2^{nd}$ optic element which is light block walls of front cover to show light beam from whole body or length of $1^{st}$ (40) and wall of front optic element; to let people see the illumination for big-area(s) not the ends. From FIG. 6 and below 29 features, the optics-lens (6*d*) (61) and optic-element (68*c*) same as the FIG. 5 the lens (40) has desired treatment including same as FIG. 5 sand-blaster or other textures or marking or reflective surface(s). This is similar with parent (#Q-2007) filed Ser. No. 11/806,284 of FIG. 14, to make the narrow emit-out LED light beams to pass through the $1^{st}$ optic-lens (61) which is one of tube having top-piece or dome on top of LED; to make the light-beam to be seem on surface of the optics-lens (400) or (6*c*) (6*d*).

From the FIG. 6 optics-lens (6*d*) or optics element (6*c*) is not a solid tubular piece and it is a slim curve piece (6*c*) (6*d*) without at least one of rear-wall so can see the wall thickness (6*e*) is very thin to save plastic expensive cost and assemble with prong unit or base (6*a*) by two-legs (6L) but can spread-out LED light-beam to whole or big-size surface of $2^{nd}$ optic piece (6*d*) or optics element (6*d*) and home wall. From FIG. 6 can see LED narrow emit-out light beam through the $1^{st}$ optic-lens (61) optics-lens and emit to $2^{nd}$ optic-lens (6*d*) or optics element (6*c*) to spread out to wider areas as FIG. 7 (7*b*) or illuminate the outside surface of block light beam $2^{nd}$ optic element(s) (7*d*).

From FIG. 8 show the optics-lens (8*f*) or optic element (8*e*) is one of even-thickness (8*g*) for substrate without rear-wall and has preferred textures or marking or optics-designs (not shown) but same FIG. 5 optics-lens (400) has sand-blaster or preferred optics treatment on the one or two surface of the optics-lens (8*f*) or optic element (8*e*) which is one of geometric unit including cartoon characters, unit, body, mask with opening(s), hole(s), light passable area(s) to shown preferred glow light, illumination from opening(s), or other light effect(s). The optic-lens (8*f*) or optic element (8*e*) has legs, slots, or gap(s) (6L) to assembly with prong unit or base (8*a*) to make light beam emit to $2^{nd}$ optics-lens (8*f*) or optic element (8*e*) and home wall.

From the FIG. 9 show the big recess area illumination (9*a*) which change from the narrow emit-out LED light beam while light beam passing through the front the 1st optics-lens (9*b*) and emit to recess 2nd optic element surface (9*a*), exposed wall (9*a*), or-and side wall(s) (9*c*) to become wider spread-out light beam to make wider-area can see the recess area (9*a*) illumination. The said added function or-and 2nd electric functions as show on FIG. 9 the two slot(s) ports (9*d*) (9*e*) or adaptor-hole (9*f*) which also can be 3 female prongs receiving outlets (same as FIG. 1 to FIG. 5) to allow other electric-device 3 male-prongs to insert as FIG. 1 to FIG. 5 shown. Wherein, the additional electric function is at least one of switch or sensor to upgrade plug-in on LED to become turn on and turn off by switch or sensor.

The said ports (9*d*) (9*e*) or adaptor-hole (9*f*) also can be any other $2^{nd}$ functions as above discussed (i) to (xv) 15 preferred type of the $2^{nd}$ electric functions. From FIG. 10 show the preferred embodiment has recess $2^{nd}$ optic elements surface(s) (10*b*) (10*c*) which has desired texture or polished or smooth treatment, optics-design to make desired recess areas has illumination from inner LED or LED(s) in any type and combination with desired circuitry to make desired light-show. From FIG. 10 also show one LED night light for simple always-on while plug night light prong into outlet or multiple function LED night light has at least one of (1) at least one switch or sensor to turn-on and turn-off LEDs, (2) other color LEDs for color changing light effects, (3) built-in outlet to supply AC power to other external products, and (4) other additional functions list on above background and details description.

Figure 12:
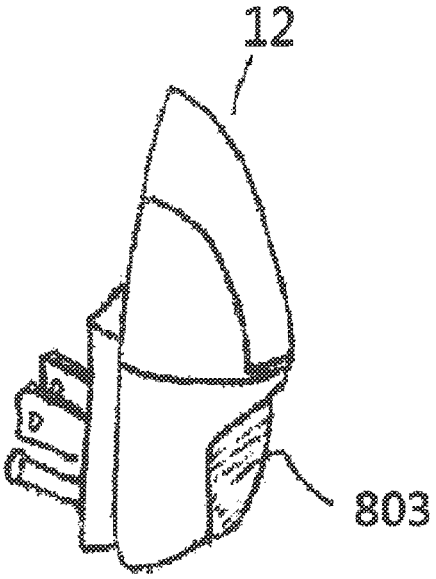
FIG. 12 is a perspective view of a fourth preferred embodiment of a multiple function LED light.
Figure 11:
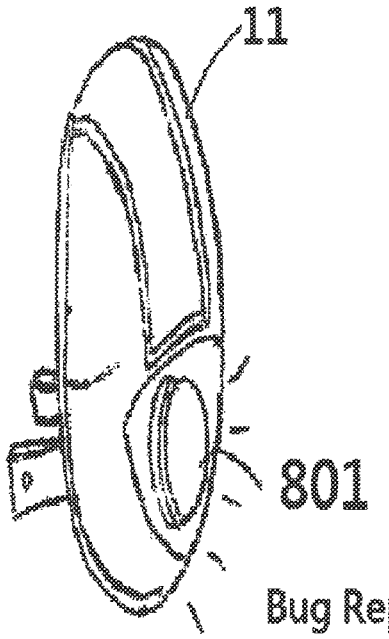
FIG. 11 is a perspective view of third preferred embodiment of a multiple function of LED light.

FIG. 11 shows a multiple function LED night light, in which the added function (801) can be selected from the group including any combination, as disclosed in co-pending U.S. patent application Ser. Nos. 11/527,631; 11/527,629; 11/498,881; 11/498,874; and 11/527,628 etc., of an air freshener, adaptor device, sonic device, frequency device, bug repeller device, second light device, timepiece, electric message device, timer device, temperature device, surge protection device, electric short circuit protection device, base device for installation on an existing lamp socket, emergency light device, or any other electric device(s) suitable for home use to keep people comfortable or safe. FIG. 12 also shows a multiple function LED night light whose added functions can be selected from the above listed functions.

Figure 13:
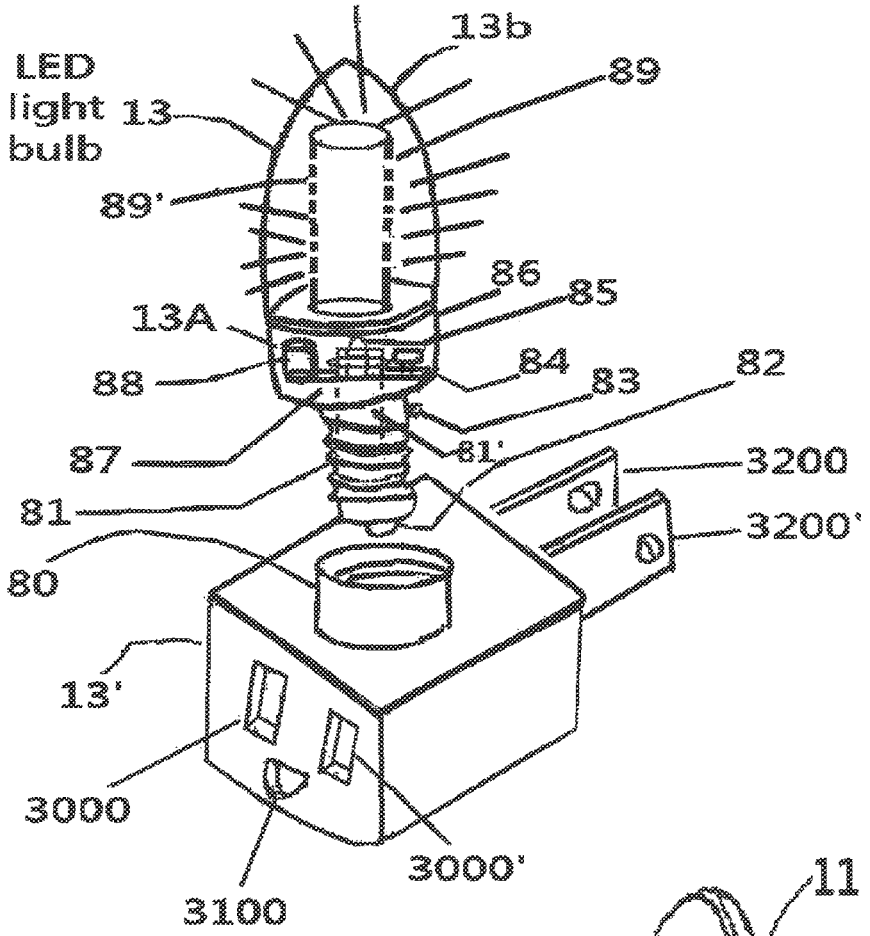
FIG. 13 is a perspective view of a fifth preferred embodiment of a multiple function of LED light with a base device for installation on an existing lamp socket.

FIG. 13 shows a multiple function LED night light in which a special LED bulb (13) is included in the existing multiple function bulb night light housing with added function (13'). The multiple function LED night light of FIG. 13 has at least one LED device installed on a geometric base that also has the added electric, mechanical, or chemical function. The base also has a bulb socket to accept the conventional bulb base, which may select from a screw type, pin type, rivet type, or knob type. The LED device has built-in circuit means to change the bulb's electric signal to an LED's electric signal so as to turn on the LED(s) to exhibit predetermined function, duration, time, and/or brightness and light effects.

As shown in FIG. 13, the base (13') has a bulb socket (80) and added adaptor function provided by the adaptor receptacles (3000) (3000') (3100), which offer electricity to other electric appliances while the prong means (3200) (3200') are connected to the wall outlet. At the same time, while prong means (3200) (3200') are connected with the wall outlet power source, the bulb socket (80) also will receive the wall outlet power source electric signal, which in the USA is around 110 Volt, 60 Hz, to turn on the bulb inserted into the base. On the other hand, specially designed LED device (13) has a built-in circuit to change the wall outlet power source of 110V AC, 60 Hz to the working voltage and frequency of the LED(s) with desired control means such as a photo sensor, PIR sensor, manual switch, or other control means available in the marketplace to turn on LED(s) according to pre-determined functions, brightness, duration, and time.

The LED device (13) that fits into the bulb socket (80) has a base type (81) which may be but is not limited to a screw type base as shown in FIG. 13. The bulb base (81) has two electric terminals (83) and (82) to connect with electric signal electrodes through an inner lamp holder (not shown) which is connected with a prong means (3200) (3200'). The electric signal from the two electric terminals (83) and (82) is supplied to the circuit board (81'), which changes the electric signal from home appliance electric current to LED working current and turns on the LED (85) for single color or multiple colors to provide a desired light performance. The LED (85) is located on the side of the circuit board (81') and connected with the bulb base electric terminals (82) (83) by conventional conductive means in circuit board (81'). The electric components (88) (85) may be installed on the circuit board (81') or connected by conductive means (87) (84) away from the circuit board (81') because some components may be too big and unable to fit within the bulb base (81). The circuit board (81') is a narrow or elongated board inserted into the bulb base (81), which is different with the prior art U.S. Pat. No. 6,227,679 (Zhang et al.) issued on May 8, 2001. The Zhang patent discloses a circuit board located on the top of the base, in a vertical relation to the circuit board and base. Also, in the arrangement of Zhang, the LEDs are not located on one side of the circuit board but rather are applied on the circuit board with a certain angle to the circuit board surface. This is because Zhang does not realize that the distance between the LED tip and the top cover is way too close and it is impossible to eliminate the spot-light problem of an LED light beam therefore cannot get a good light performance on the bulb surface. The current invention uses the invention described in one of the co-pending applications listed above, of an LED night light with more than one optics means, to make the spot-light beam into an area-light by first optic means. By adding a second optics means, the light beams brightness will be very close at every point on the desired area or surface.

As shown in FIG. 13, LED (86) on is situated on the edge of the circuit board (81') and positioned such that light beams from the LED are input to the first optics means (89) to cause the light beams to travel within the first optics medium (89). The top may use a dome shape design or a "V" shape design to collect light beams that hit the top area of the first optics medium. It will be appreciated that all equivalent treatments such as metallization of the top area or adding reflective arrangements within the first optics medium will be still fall within the scope of the invention. The LED device (13B) with screw type base can fit into a bulb night light's base socket (80) to replace the bulb and let the existing bulb night light become an LED night light without having to purchase a brand new unit to save money and change the big power consumption device into a lower power consumption device in seconds.

FIG. 14 show the Parent filing case for current invention and (#FF-4) (#FF-3) (#FF-2) (#FF-1) and (#II-2009) (#II-II) is the (#Q-07) as above discussed so not discuss more details here. Which also is parent filed case of (#R-2007) which is filed on same date of(#Q-2007) which is parent of division filed cases of(#R-1) (#R-2) (#R-3) (#R-4) (#R-5) (#R-6).

One of preferred embodiment, from FIG. 14 show the 1$^{st}$ optics-element or optics-lens is one of tube construction. It is appreciated the 1$^{st}$ optic-lens can be any construction such as dome (short of tube (30)), cone (sharp top of tube (30)), partial circle (half of tube (33)), curved piece (less than ½ tube (30)), flat piece; with or without air-bubble (33), reflectors (33), reflective, refractive, reflective and refractive optics-properties.

One of preferred embodiment, from FIG. 14 show the 2$^{nd}$ optics-element or 2$^{nd}$ optic-lens or 2$^{nd}$ outer piece is one of detachable, separated piece which at least lack of one of (i) rear housing, (ii) side housing, (iii) rear and all sides housing; with or without at least one of (aa) U-shape or other-shape opening, (bb) built-in or add-on clipper, (cc) geometric shape clipper to clip-on or push-tight or assembled with base (2*b*) neck or groove or ditch (38).

One of preferred embodiment, from FIG. 14 show the said LED night light has built-in at least one of 2$^{nd}$ LED(s) or more LED(s) to create at least one preferred light functions or performance for examples (i) color changing, (ii) color selection, (iii) brightness adjustable, (iv) fade-in or fade-out, or (v) other LED light function(s) or effect(s) available from marketplace while incorporate with at least one of (aaa) sensor (37), (bbb) IC on PCB, (ccc) switch(s), (ddd) wireless controller, (eee) slide switch.

From FIG. 14 also disclosure the said LED night light have at least one of additional functions, or features select from (additional 1) outlet(s), or female receiving end(s), or terminal(s), or output(s), or port(s) as co-pending (#R-2007 U.S. patent Ser. No. 11/806,285 filed on May 31, 2007 same date of FIG. 30 which is (#Q-2007)).

(additional 2) motion/radar/photo/CDS sensor, (additional 3) PIR sensor, (additional 4) Air Freshener (additional 5) second LED light or color LED light for area(s) or status indicator illumination.

(additional 6) bug repellent, (additional 7) sonic repellent, (additional 8) time piece, (additional 9) supply AC or DC power device through outlet(s) or charger system(s)

(additional 9) any electric function(s) or features(s) combination from marketplace 1.

This arrangement solves the problem with the arrangement disclosed in the Zhang patent cited above that there is not enough space in a night light having the most popular dimensions to achieve a good area lighting effect. The most popular night light length is around 88 mm+/−50 mm (with base). The lens height is around 60 mm+/−30 mm (without base). The distance from the wall outlet cover to the highest point of the night light edge is around 35 mm+/−15 mm (from outlet cover surface). If placed in the same location as the existing bulb night light, the distance from the bulb socket to the wall outlet surface will be less than 35 mm. This distance from the wall to outside of the lens will only be less than 35 mm+/−15 mm. It is too short to change the spot-light effect of the LEDs into a surface or area lighting effect. The solution, as disclosed in the co-pending application is to use two optics means to get a good surface or area lighted effect. This will be the best because LED night light power consumption falls within the 0.3 W+/−100% per LED range, whereas a bulb night light falls within a 4 Watt+/−50% per bulb range. As a result, the LED night light will have a big power saving and help reduce monthly electric bills for the consumer.

The current invention also had below (29) features;

1. A multiple function LED night light,
comprising:
at least one LED;
at least one first optical element;
at least one of built-in fixed and non-pivotal outer front lens or second optical element or exposed curved walls,
wherein the at least one first optical element includes or is at least one of:
(i) an elongate piece or unit or plate;
(ii) a cone or dome or tube unit;
(iii) an annular piece having at least one or plurality of (a) levels, (b) diameters, (c) rings, (d) one of reflective or refractive or reflective and refractive surface(s) or pieces;
(iv) an at least partially cylindrical optical element or reflective piece,
wherein the first optical element causes a spotlight beam from the at least one LED to spread out but not diffusion effects, incident on
(a) an inner surface of the front lens or exposed curved wall(s) or second optical element surface, or
(b) an inner wall of the night light; to provide illumination without super bright lighted spot(s) shown on at least one of (i) front lens or (ii) exposed curved wall(s) or (iii) second optical;
wherein the night light further includes at least one electrical circuit connected to at least one prong to change electricity from a home wall AC power source to DC power source for the at least one LED and to at least one added function(s) or device(s), and
wherein the at least one added function or device includes at least one of
(1) color LED(s), or
(2) a second sensor(s), or
(3) a manual or electric switch(s) to select color, function(s), or brightness, or
(4) Integrated circuit (IC), or
(5) control system for brightness or color or function(s); to provide light functions that are in addition to the illumination without super bright lighted spot(s).

2. The multiple function LED night light as discussion 1, wherein the at least one LED(s) is one of a single-color LED(s), a plurality of colored LEDs, and a multiple color LED(s).

3. The multiple function LED night light as discussion 1, wherein the night light is arranged to accommodate at least one of an added female (i) adaptor, (ii) outlet unit, (iii) electric receiving structure; for supplying or charging power to the external electric product(s), or a surge protection related device(s).

4. The multiple function LED night light as discussion 1, wherein the at least one added function(s) or device(s) is selected from at least one of the following functions:
A. At least one of back-up battery powered emergency light, power fail light, or flashlight function(s);
B. At least one front or outer second optical element(s) or optical lens or exposed wall having arrangement or treatment select from; (i) translucent, (ii) whitened, (iii) textured, (iv) sand-blasted, (v) polished; to eliminate super bright lighted spot(s) illumination;
C. At least one front or outer second optical element(s) or optical lens or exposed wall related to at least one LED(s) is; (aa) positioned or installed on contoured or side(s) of LED light, or (bb) is position front or top of 1$^{st}$ optic element in preferred ring or square or geometric shaped which is one of injected piece or light block piece;
D. At least one of indicator light function with preferred size, color(s), brightness for indicating status selected from; at least one charging status, power on/off status, surge system status, ground status, protected status, or switch location;
E. At least one function(s) selected from; color changing, color selection, auto color changing, color freezing; controlled by an integrated circuit (IC).

5. The multiple function LED night light as discussion 1, wherein the at least one added-function device includes at least one of
(i) conductive wire(s) or USB-wire has at least 2 male-plug(s) to input or output power; or
(ii) female receptacle(s) or assembly to connect or receive at least one of electric wire(s) or male plug(s) of at least one or plurality external be-charged or be-supplied product(s).

6. A multiple function LED night light, comprising:
at least one LED arranged to emit light through a first optical element to at least one of fixed (a) front optics-lens, (b) exposed wall(s), (c) second optical element(s).
wherein the at least one first optical element includes or is at least one of:
(A) an elongate piece or unit or plate;
(B) a cone or dome or tube unit;
(C) an annular unit having at least one of multiple (1) levels, (2) diameters, (3) rings, (4) reflective or refractive or reflective and refractive surface(s);
(D) an at least partially cylindrical shape optics or reflective piece; or
(E) a linear or elongated piece having at least one reflective or refractive surface; and wherein the first optical element causes at least one LED super bright lighted spot(s) to spread out but not diffusion effects, incident on (a) an inner surface of the front lens or second optical element; or surface(s) of exposed wall(s), or (b) an inner wall of the night light to provide illumination without bright lighted spot(s) shown on at least one of the front lens or-and exposed wall(s);

wherein the night light further includes at least one electrical circuit connected to at least one prong to change AC electricity from a home power source to DC power for the at least one LED(s) and to at least one added function device.

7. A multiple function LED night light as discussion 6, wherein the at least one additional function or device or parts selected from; integrated circuit (IC), switch, second sensor(s) to control the LED(s), color(s), brightness, function(s) besides the non-bright lighted spot(s) illumination of LED light.

8. The multiple function LED night light as discussion 6, wherein the at least one added function device includes at least one switch having (1) multiple position, or (2) slide range, or (3) twist angle, or (4) variable resistance.

9. The multiple function LED night light as discussion 6, wherein the switch to select, change, set, or adjust at least one (i) brightness, (ii) color, (iii), motion sensor or photo sensor control functions, (iv) color auto or manual changing, (v) color holding or sequential changing, (vi) power fail light on/off/auto functions, (vii) power on or off, (viii) hi-low brightness, (ix) motion or dust-to-dawn function, or (x) reset upon detection of a power surge or short circuit.

10. An LED night light, comprising:

at least one LED arranged to emit light through (i) a first optical element, and (ii) a second optical element which is a separate unit without a rear housing and that configured with a prong circuit-unit by at least one clip, or U-shape opening, or screw, or push-tight construction, wherein the first optical element is positioned in front or top or side of the at least one LED to prevent people from touching said at least one LED and other inner parts of the LED night light, wherein light beams exiting the first optical element are emitted to at least one of:

(1) an inner surface of the second optical element;

(2) an inner surface(s) of the night light;

(3) a home wall having an outlet for receiving night light prong, the home wall being exposed because second optical element lack of a rear housing and home wall lighted by light beam exit from $1^{st}$ optical element, wherein the light beams exiting the first optical element go through at least one reflection, refraction, or reflection and refraction for multiple times between or within at least two of the (1) the surface of first optical element, (2) the inner surface the second optical element, (3) the inner surface of the night light, (4) the home wall; to provide illumination without super bright lighted spot(s), wherein the night light further includes at least one electrical circuit connected to at least one prong to change AC electricity from a home wall power source to DC power for the at least one LED for preferred illumination(s).

11. An LED night light as discussion 10, further including at least one of added function device is a non-wireless electrical device that is in addition to the at least one LED to provide a function other than said uniform brightness illumination or illumination without super bright lighted spot(s).

12. An LED night light as discussion 10, further including at least one electric circuit include electrical components selected from the group consisting of a resister, capacitor, switch, sensor, diode, inductor, transformer, and integrated circuit.

13. An LED night light as discussion 10, further including at least one electric circuit is configured to drive the at least one LED according to a predetermined timing, effects, and brightness and thereby provide said function other than said uniform brightness illumination or illumination without super bright lighted spot(s).

14. An LED night light, comprising:

at least one LED arranged to emit light through (i) a first optical element, and (ii) a second optical element which is a separate or detachable unit without a rear housing and that configured with a prong circuit-unit by at least one clip, or U-shape opening, or screw, or push-tight construction, wherein the first optical element is positioned in front or top or side(s of the at least one LED to prevent people from touching said at least one LED and other inner parts of the LED night light, wherein light beams exiting the first optical element are emitted to at least one of:

A. an inner surface of the second optical element;

B. a surface of the night light;

C. a home wall having an outlet for receiving night light prong, the home wall being exposed because second optical element lack of a rear housing and home wall lighted by light beam exit from $1^{st}$ optical element directly, wherein the light beams exiting the first optical element reflect, refract, or reflect and refract multiple times between or within at least two of the (1) the surface of first optical element, (2) the inner surface of second optical element, (3) the surface(s) of the night light, and (4) the home wall; to provide illumination without super bright lighted spot(s), wherein the night light further includes at least one electrical circuit connected to at least one prong to change AC electricity from a home wall power source to DC power for the at least one LED(s), wherein the night light further includes at least one of photo sensor or manual switch to turn on and turn off the light function(s).

15. A LED night light, comprising:

at least one LED arranged to serve as a light source for:

(A) Providing illumination without bright lighted spots shown on at least one surface(s) of (i) outer front lens or (ii) exposed wall(s); wherein surface(s) being translucent, whitened, polished, textured, painted, or one of cartoon character design with glow light or light emit out from shape opening(s); Wherein the LED(s) light beam (i) go through, or (2) travel, or (3) reflected or refracted or reflected and refracted between or within; at least two of:

(a1) a first optical lens that is one of a
(a) tube,
(b) dome,
(c) cone,
(d) partial cylinder,
(e) elongate or curved shape plate or piece with at least one of reflective or refractive or reflected and refracted surfaces,
(f) ring or annular construction unit(s) or lens(es) having more than one of surfaces or levels,
(g) curved or partial cylinder reflect or refract piece; to eliminate LED(s) super bright lighted spot(s) but not diffusion effects;
(a2) at least one surface(s) of front or outer optical lens or second optical element, or
at least one surface(s) of exposed wall(s);
having reflective, or refractive, or reflected and refracted properties; wherein light passable surface(s) having at least one white treatment, translucence, painting, polished or tooled texture;
(a3) (i) inner surface of night light, or (ii) exposed wall(s); those light reflecting but no refractive, or LED light not able go through or
(B) a preferred size or color or brightness location or status indicator light positioned under or behind prismatic, treated, or translucent lens, or exposed to viewer; and
at least one electrical circuit connected to at least one prong to change electricity from a home wall AC power source to DC power source for the at least one LED, 16. A LED night light as discussion 15, further has at least one added function(s) or device(s) which is at least one of an (1) an air-freshener, (2) a sound or audio device, (3) a bug repeller, (4) a time, date, or weather related device, and (5) a timer to set a sleep or wakeup light with an alarm setting device.
17. A LED night light as discussion 15, further has at least one additional function(s) or device(s) which is an electrically conductive receiving (i) end(s), (ii) adaptor(s), (iii) electrical power output or input device, or (iv) outlet device; to supply power to another product.
18. A LED night light as discussion 15, further has at least one additional function(s) or device(s) which is a second or group LED(s) or LED light with an integrated circuit (IC) to provide a multiple or changing or selecting color(s) light performance.
19. A LED night light as discussion 15, further has at least one additional function(s) or device(s) which is a second or group of LED(s) or LED light device incorporated with integrated circuit (IC) or sensor(s) or control circuit; to provide at least one of power fail light, emergency light or flashlight function; those have at least one of backup battery and that emits light from a second location different from the outer front lens.
20. A LED night light as discussion 15, further has additional function(s) or device(s) which is a second or group of LED(s) or LED light for indicator-light to show one of (1) charging status, or (2) location of night light, or (3) protected system status; with one or more than one colors to show pre-determined color(s).
21. A LED night light as discussion 15, further has at least one function(s) or device(s) which is a plurality of LEDs with an integrated circuit (IC) for multiple color or adjusting brightness or pre-determined LED light effects, at least including at least one of auto or manual changing light effects and color selection.
22. A LED night light as discussion 15, further has at least one function(s) or device(s) which is plurality of LEDs light effect(s) or illumination(s) shown on at least one (i) front or second optic-element(s), (ii) optics-lens having translucent, or whiten, or textures, (iii) built-in or exposed reflective walls.
23. A LED night light as discussion 15, further has at least one function(s) or device(s) which is one of surge, or short circuit, or overcharge, or overheat protection device, or another safety device, while LED night light having at least one AC outlet(s).
24. A LED night light as discussion 15, further has at least one function(s) or device(s) which is a switch having more than one position(s) or slide-range(s) or twist-angle(s) to set, adjust, or select at least one of colors, brightness, sound, time, auto changing color, color freezing, or an on/auto/off power function.
25. A multiple LED night light as discussion 15, further has at least one additional function(s) or device(s) which is an AC outlet with female receiving ends or ports
26. A LED night light as discussion 15, further has at least one additional function(s) or device(s) which is one of sensor system selected from a motion PIR sensor, a photosensor, or radar sensor.
27. A LED night light as discussion 15, further has at least one additional function(s) or device which is one of slide switch to set, adjust, or select at least one of variable brightness.
28. A function LED night light as discussion 15, further has at least one additional function(s) or device which is a switch to select at high or low brightness.
29. A LED night light with built-in AC-outlet(s), comprising;
At least one LED(s) offer at least one of (1) area(s), (2) status indicating illumination for preferred size or area(s).
At least one of Outlet built-in LED night light to deliver or supply AC power from LED night light male-prong through built-in female conductive (i) piece(s) or (ii) receiving port(s) those receive external AC operated electric product(s) male AC plug(s) or prong(s).
Wherein, the LED night light has built-in AC-to-DC circuit which change home AC power to DC power for circuit to drive at least one LED(s), integrated circuit (IC), sensor(s), switch(s) to create pre-determined LED light function(s) or effect(s).

From above discussed and mentioned of preferred embodiments to show the scope of the current invention, it is appreciated that any alternative or equivalent functions of design still within the scope of the invention but not limited to all above discussion and mentioned details. The alternative or equivalent arrangement, process, installation or the like design, changes from the current invention still fall within the scope of the current invention.

The invention claimed is:

1. An LED night light, comprising:
at least one LED;
at least one first optical lens;
at least one of an outer front lens, a second optical element or lens, and an exposed wall,
wherein the at least one first optical lens is configured to
(a) prevent people from touching inner electric parts or the at least one LED, and (b) change a light beam emitting angle, and includes or is at least one of:

(1) a first optics lens fitted on a prong circuit unit or base, wherein the first optics lens is at least one of:

(A) a flat or planar optics lens positioned in front of or on top of the at least one LED; and (B) a cone unit having a sharp tip, or a dome or tube unit having a top end, the cone unit, dome, or tube unit being positioned in front of, surrounding, or on top of the at least one LED to cause a light beam to travel back and forth and be reflected and refracted multiple times;

(2) a partially cylindrical first optical lens fitted on a side of the prong circuit unit or base and positioned on a side or front of the at least one LED to cause a light beam to be reflected multiple times inside the prong circuit unit or base to eliminate LED bright spots, wherein the light beam exiting from the first optic lens is incident on:

(a) an inner surface of the front lens, the second optic element, or an exposed wall, or the second optical element, and (b) a home wall because the second optical lens lacks at least one rear, top, or side wall;

to provide illumination without bright lighted spots on at least one of: (i) the front lens, (ii) the second optic element or exposed wall, (iii) the home wall, (iv) the second optical element or lens, and (v) a cartoon mask, unit, or body having art, at least one opening, or at least one transparent area;

wherein the prong circuit unit or base has built-in (i) a prong, (ii) the at least one LED, (iii) circuitry, (iv) a manual switch or a photo sensor, and (v) an AC-to-DC circuit to change electricity from a home wall AC power source to DC power for the at least one LED and an added function or device, and wherein the added function or device is or has at least one of:

(1) at least one color LED in addition to the at least one LED, or the at least one LED emitting a white color light beam, (2) at least one second sensor in addition to the photo sensor, (3) the manual switch or an electric switch to select, change, or set a color, function, or brightness, in addition to turning on and off, (4) an integrated circuit (IC) for at least one of a light color, effect, and function, and (5) a control system for controlling brightness, color, or function, or a circuit to control turn on and turn off of the at least one LED;

to provide light functions that are in addition to white color always-on illumination without bright light spots while the night light is plugged into an outlet.

2. An LED night light as claimed in claim 1, wherein the at least one LED is at least one of a single-color LED, a plurality of colored LEDs, and multiple different color chips or dice built inside one LED.

3. An LED night light as claimed in claim 1, wherein the night light includes at least one additional female (i) adaptor, (ii) outlet unit, or (iii) electric receiving structure.

4. An LED night light as claimed in claim 1, wherein the night light further includes at least one added function or device selected from at least one of the following:

A. at least one of a backup battery powered emergency light, a power fail light, and a flashlight;

B. at least one front or outer second optical element, optical lens, or exposed wall having an arrangement or treatment that is/has at least one of (i) a translucent piece, (ii) a whitening treatment, (iii) a textured treatment, (iv) a sand-blasted treatment, and (v) a polishing treatment, to eliminate bright light spot illumination;

C. at least one front or outer second optical element, optical lens, or exposed wall related to the at least one LED and that is: (aa) positioned or installed on at least one contour or side of the LED night light, or (bb) positioned in front of, on top of, or on side of the first optic element, and that is an injected piece or light blocking pieces with a ring, square, or geometric shape;

D. at least one indicator light function with preferred size, color or colors, or brightness for indicating at least one of: (1) charging status, (2) power on/off status, (3) surge system status, (4) status of power level or percentage, (5) protected status, and (6) switch location; and E. at least one of: (1) color changing, (2) auto color changing, and (3) color freezing, controlled by an integrated circuit through a wired or wireless system.

5. An LED night light as claimed in claim 1, wherein the night light further includes at least one added function device having at least one of:

i. at least one conductive wire or USB wire for at least one detachable or separable USB unit having at least two USB female ports to input or output power; and ii. at least one female receptacle or assembly to connect or receive at least one of an electric wire or male plug of at least one external product.

6. An LED night light, comprising:

at least one LED arranged to emit light through a first optical element to at least one of an optical element, optic lens, cartoon unit, light blocked exposed surface, and home wall; and a first optics lens fitted on top or in front of a prong circuit unit or base and in front of, on a side of, or on top of the at least one LED, wherein the first optics lens is at least one of:

(A) a flat or planar optics lens that transmits or changes a direction of light beams;

(B) a cone unit having a sharp tip, or a dome or tube unit having a top end, to cause a light beam to travel back and forth and be reflected and refracted multiple times; and (C) a partial cylinder lens having an opaque, whitening, or textured treatment to cause light beams to travel back and forth and be reflected and refracted multiple times;

thereby providing LED illumination without bright lighted spots shown on at least one of:

(1) a front lens, (2) a second optic lens in front of or surrounding the first optic lens and that is or has at least one bubble, is textured, or has at least one treatment, (3) one of a cartoon mask, body, or unit having at least one transmitting area or at least one hole, (4) a home wall that is exposed because the second optic lens or a second optic element lacks at least one of a rear, side, and top wall, and (5) a light blocked optic element surface or exposed wall of the night light, wherein the prong circuit unit or base includes a prong, AC-to-DC circuit, circuitry, at least one white color LED, a manual switch, or a photo sensor.

7. An LED night light as claimed in claim 6, further including an additional function or device that is or has at least one of: an integrated circuit, a switch, and at least one second sensor to control the at least one LED, or a color, brightness, or at least one function of the LED night light other than always-on illumination while the LED light is plugged into an outlet.

8. An LED night light as claimed in claim 6, further including an additional function or device that is a switch which is or has at least one of (1) multiple positions, (2) slide ranges, (3) twist angles, (4) variable resistances, (5) a conductive switch, and (6) a push switch.

9. An LED night light as claimed in claim 6, further including an additional function or device that is or has at least one integrated circuit and switch to select, change, set, or adjust at least one of: (i) brightness, (ii) color, (iii) motion sensor or photo sensor control functions, (iv) auto or manual color changing, (v) freeze or sequential color changing, (vi) power fail light having on/off/auto selection functions, (vii) power on or off, (viii) high or low brightness, (ix) motion or dusk-to-dawn activated-function, and (x) reset system basing detection of a power surge or short circuit.

10. An LED night light, comprising:

at least one LED arranged to emit light through (A) a first optical lens fitted on top of a prong circuit base or a side of a prong circuit unit, the prong circuit base or prong circuit unit having, inside the base or unit, at least one LED, circuitry, an AC-to-DC circuit, and one of a photo sensor or switch, and (B) a second optical lens or element without at least one of a rear, top, or side wall and that is assembled to a prong circuit base or unit, wherein the first optical lens is at least one of:

(1) a tubular, planar, or dome piece fitted on top or in front of the prong base or unit and positioned in front or top of the at least one LED, and (2) a partial cylinder piece on at least one side of the prong base or unit and positioned on a side of the at least one LED;

to (i) prevent people from touching the at least one LED and parts inside the prong base or unit, or (ii) provide illumination without bright light spots, wherein light beams exiting the first optical lens are emitted to A. an inner surface of the second optical lens or element; and B. a home wall having an outlet for receiving a night light prong, the home wall being exposed because the second optical lens or element lacks a rear wall and the home wall is lighted by a light beam exiting from the first optical lens or element, wherein the second optical lens or element is at least one of:

(1) an optic lens having at least one of: (1-1) a reflective, (1-2) refractive, (1-3) textured, and (1-4) reflective and refractive property, and (2) a cartoon or movie character unit, body, or mask; having at least one of (2-1) art, (2-2) design, (2-3) a shape, (2-4) painting, (2-5) printing, (2-6) colors, (2-7) at least one light transmitting area, (2-8) at least one window, (2-9) at least one opening, and (2-10) at least one cutout.

11. An LED night light as claimed in claim 10, further including at least one added function device which is in addition to the at least one LED to provide a function other than always-on illumination while the LED light is plugged into an outlet.

12. An LED night light as claimed in claim 10, further including at least one electric circuit include electrical components selected from the group consisting of a resistor, capacitor, switch, sensor, diode, inductor, transformer, and integrated circuit.

13. An LED night light as claimed in claim 10, further including at least one electric circuit that is configured to drive the at least one LED, the at least one LED having (1) a single white color, and/or (2) built-in multiple different color chip or dice; to provide a desired timing, effects, and brightness and thereby provide said function other than always-on illumination while the LED light is plugged into an outlet.

14. An LED night light, comprising:

at least one LED arranged to emit light through i. a first optical lens fitted within a prong circuit base or unit having a built-in LED, an AC-to-DC circuit, and a photo sensor or manual switch inside the base or unit, and ii. a second optical element which is a separate or detachable unit without at least one of a rear, side, and top housing, and that is assembled to the prong circuit base or unit, wherein the first optical element is at least one of tube, dome, and planar piece which is not bulb-shaped, the first optical element being positioned in front or on top of the at least one built-in LED to (a) prevent people from touching the at least one built-in LED and parts inside of the prong base or unit, or (b) eliminate LED bright spots or change a light beam emitting direction, wherein light beams exiting from the first optical lens are emitted to A. an inner surface of the second optical lens or element; and B. a home wall having an outlet for receiving a night light prong, the home wall being exposed because the second optical lens or element lacks a rear housing to that the home wall is lighted by light beams exiting from the first optical element.

15. An LED night light as claimed in claim 14, further including at least one added function or device which is at least one of: (1) an air-freshener, (2) a sound or audio device, (3) a bug repeller, (4) a time, date, or weather related device, and (5) a timer to set a sleep or wakeup light with an alarm setting device.

16. An LED night light as claimed in claim 14, further including at least one electrically conductive receiving (i) end(s), (ii) adaptor(s), (iii) electrical power output or input device, or (iv) outlet device to supply power to another product.

17. An LED night light as claimed in claim 14, further including at least one of LED selected from a second LED, a group of LEDs, and an LED light with an integrated circuit to provide multiple, changing, or selected color light performances.

18. An LED night light as claimed in claim 14, further including at least one of a second LED, a group of LEDs, and an LED light device; incorporated with at least one of an integrated circuit, sensor, and a control circuit; to provide at least one of a power fail light, an emergency light, or a flashlight; having at least one backup battery and arranged to emit light from a second location different from the outer front lens.

19. An LED night light as claimed in claim 14, further including at least one of a second LED, a group of LEDs, and an LED light device for an indicator light to show at least one of (1) a charging status, (2) a location of the night light, and (3) a protected system status with one or more than one colors to show different statuses or positions.

20. An LED night light as claimed in claim 14, further including at least one or a plurality of LEDs incorporated with an integrated circuit (IC) for at least one of (i) providing multiple colors, (2) adjusting brightness, (3) predetermined LED light effects, (4) auto or manual changing light effects, and (5) color selection.

21. An LED night light as claimed in claim 14, further arranged to exhibit a plurality of LED lighting effects or illumination functions shown on at least one of: (i) at least one front or second optic lens or element, (ii) an optics-lens having at least one of a translucent, whitened, or textured surface, and (iii) built-in or exposed reflective walls.

22. An LED night light as claimed in claim 14, wherein the LED night light has at least one AC outlet and further includes at least one of a surge protection device, a short circuit protection device, an overcharge protection device, an overheat protection device, and another safety device.

23. An LED night light as claimed in claim 14, further including at least one switch having more than one position, slide range, push level, or twist angle to set, adjust, or select at least one of colors, brightness, sound, time, auto changing color, color freezing, and an on/auto/off power function.

24. An LED night light as claimed in claim 14, further including an AC outlet with female receiving ends or ports.

25. An LED night light as claimed in claim 14, further including a sensor system including at least one of a motion PIR sensor, a photosensor, and a radar sensor.

26. An LED night light as claimed in claim 14, further including a slide switch to set, adjust, or select a brightness of the LED night light.

27. An LED night light as claimed in claim 14, further including a switch to select high or low brightness of the LED night light.

* * * * *